US005399109A

United States Patent [19]

Sedig

[11] Patent Number: 5,399,109

[45] Date of Patent: Mar. 21, 1995

[54] QUICK-RELEASE CONNECTOR MODULE

[75] Inventor: Albert R. Sedig, Buckeye, Ariz.

[73] Assignee: ITT Corporation, Secaucus, N.J.

[21] Appl. No.: 104,869

[22] Filed: Aug. 10, 1993

[51] Int. Cl.[6] ..... H01R 13/502

[52] U.S. Cl. ..... 439/701; 439/347

[58] Field of Search ..... 439/345, 347, 695, 701

[56] References Cited

U.S. PATENT DOCUMENTS

| | | | |
|---|---|---|---|
| 1,886,959 | 11/1932 | Johnson . | |
| 2,626,974 | 1/1953 | Howard et al. | 173/328 |
| 2,638,574 | 5/1953 | Webb . | |
| 4,090,764 | 5/1978 | Malsby et al. . | |
| 4,146,682 | 3/1979 | Nakao | 429/97 |
| 4,201,437 | 5/1980 | Lockyer . | |
| 4,542,946 | 9/1985 | Snow . | |
| 4,699,590 | 10/1987 | Farrar et al. | 439/95 |
| 4,775,328 | 10/1988 | McCarthy | 439/211 |
| 5,190,479 | 3/1993 | Jordi | 439/620 |

*Primary Examiner*—Khiem Nguyen

*Attorney, Agent, or Firm*—Thomas L. Peterson

[57] ABSTRACT

A multi-bay electrical connector is described, of the type that has a frame (12, FIG. 2) with cavities (14) that each holds a separate module 20, which enables quick withdrawal of a single module from the frame and its quick replacement. A lock arm (42) is slidable along a first side (50) of a first cavity, and has at least one lock lug (80). A first module has a barrier part (70) that lies inward of the lock lug, which prevents outward movement of the first module out of the frame cavity. The lock arm can be moved to an unlocked position wherein the barrier part on the module lies inward of a gap (84) in the lock arm to permit the module to be pulled out of the frame cavity and later inserted therein. A latch (54) is slidable on the frame in directions (A, B) perpendicular to the sliding movement of the lock arm, and has an abutment (112, FIG. 5) that abuts a shoulder (114) on the lock arm to keep the lock arm in its unlocked position until the latch is released.

8 Claims, 3 Drawing Sheets

LOCKED

UNLOCKED

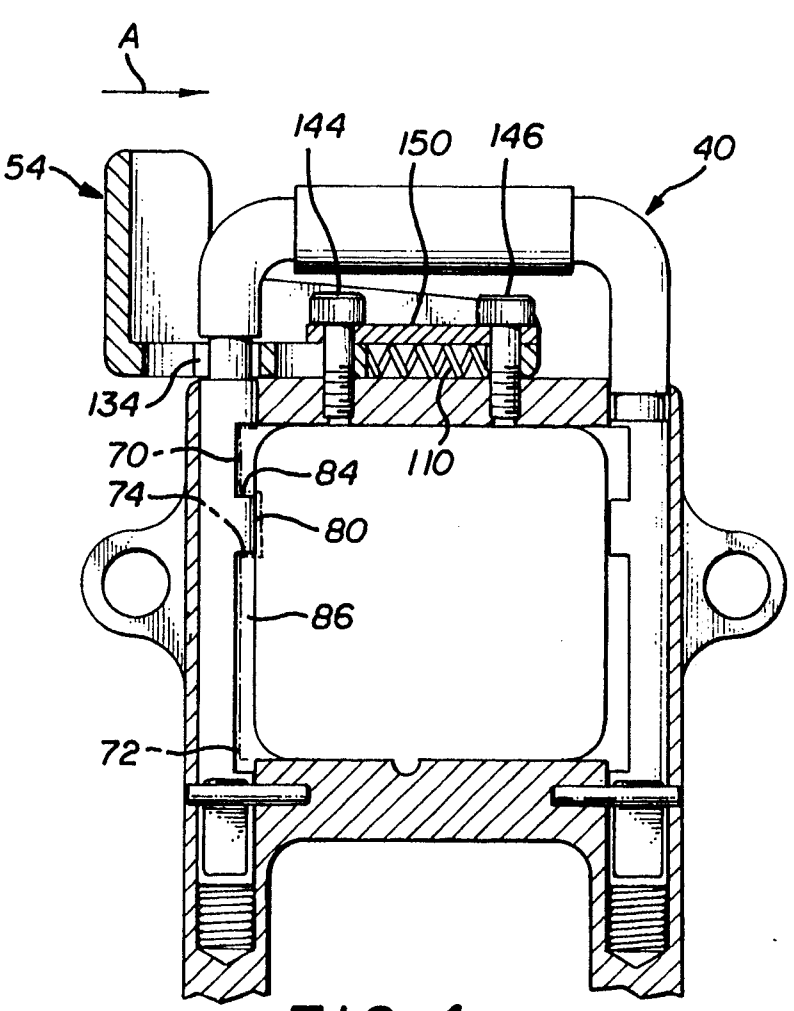
FIG. 4 UNLOCKED
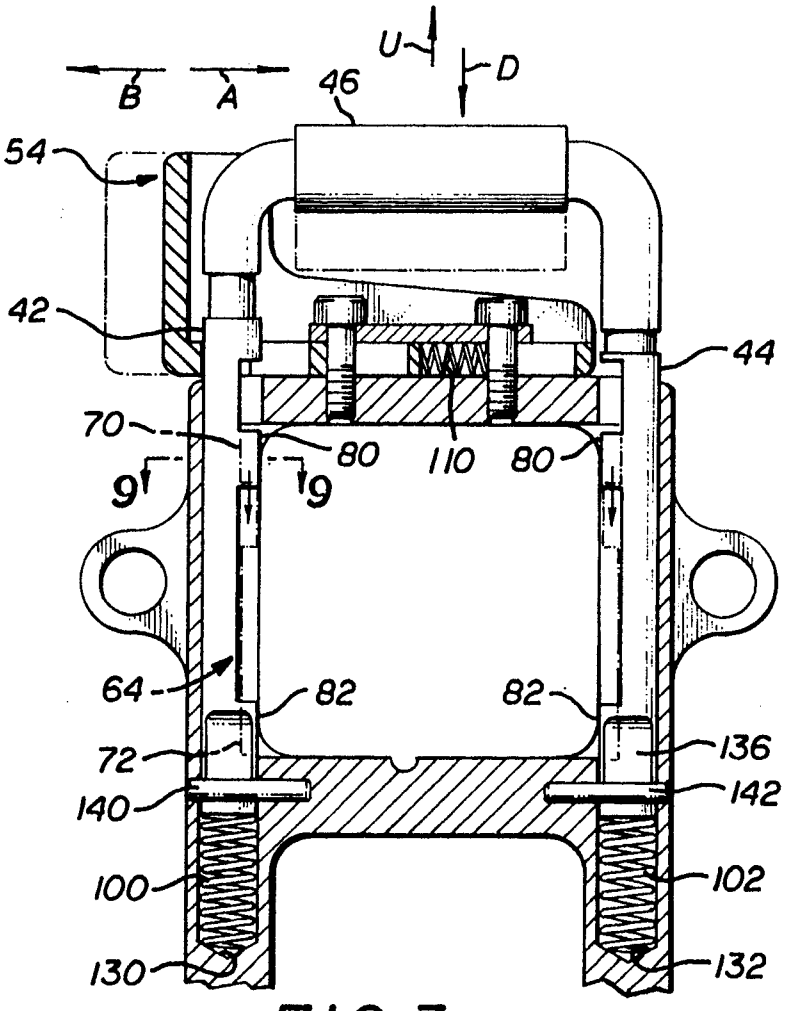
FIG. 3 LOCKED

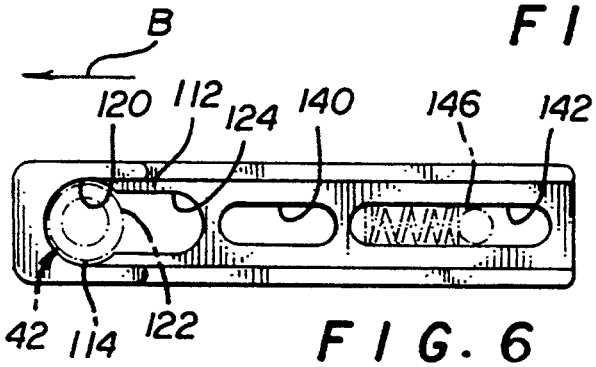
FIG. 6
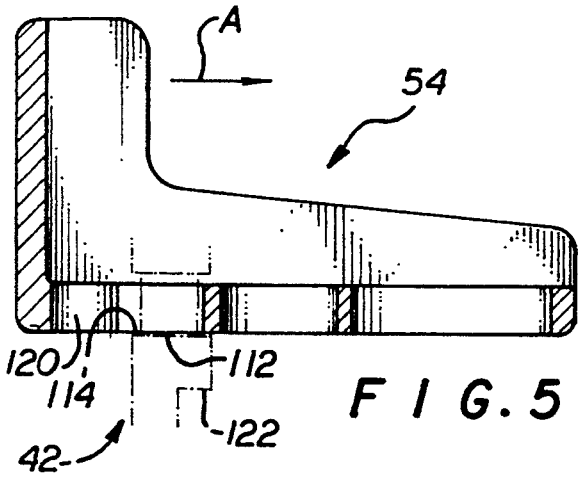
FIG. 5
FIG. 7
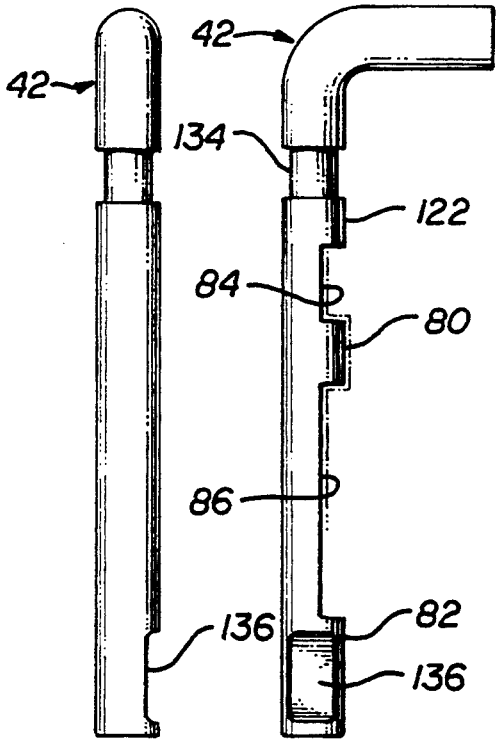
FIG. 8
FIG. 9
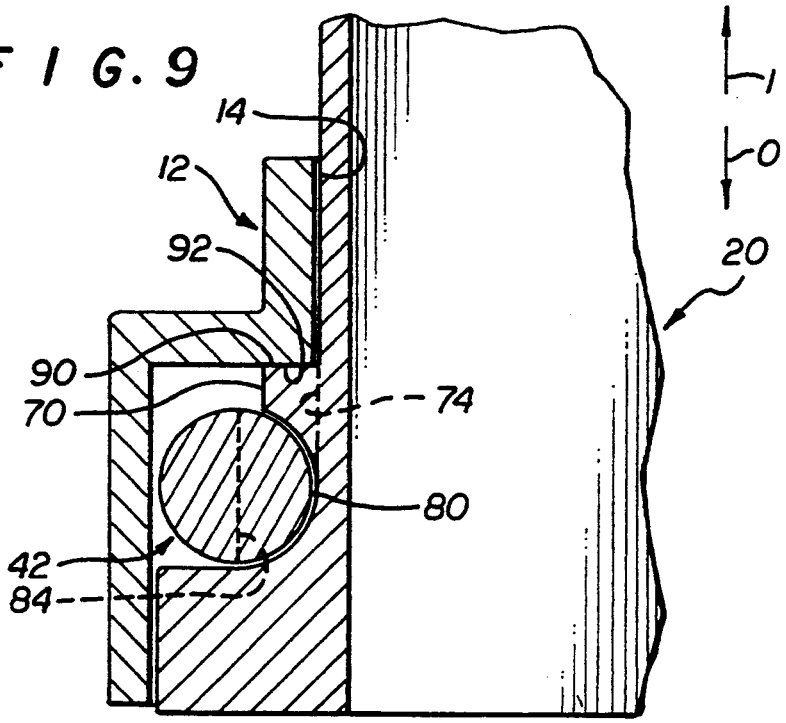

QUICK-RELEASE CONNECTOR MODULE

The invention described herein was made in the performance of work under NASA Contract No. NAS 3-25082 and is subject to the provisions of Section 305 of the National Aeronautics and Space Act of 1958 (42 U.S.C. 2457).

BACKGROUND OF THE INVENTION

One type of electrical connector, which may be referred to as a multi-bay type, includes a frame with two or more cavities that can each hold a replaceable connector module. Each module includes a dielectric insert with passages that each holds a contact, with a metal shell usually surrounding the insert. Such multi-bay connectors enable a single module to be removed and either modified or replaced before reinsertion. Each module is usually held to the frame by screws, whose heads may be at the rear, or outer ends of the modules, from which multiple wires may extend.

It is difficult to replace a single module in the field, because of difficult access to the several screws holding the module to the frame, especially where multiple wires extend outwardly from the frame to a nearby structure. If a single module could be released from the frame without requiring access to an area at the rear, or outer end of the frame, module replacement in the field would be much easier. In fact, rapid release and reinstallation of modules could allow a single module to be pulled out and replaced, while other modules of the connector remained mated to other connectors.

SUMMARY OF THE INVENTION

In accordance with one embodiment of the present invention, an electrical connector is provided, of the type which includes a module that can be inserted inwardly and removed outwardly from a cavity in a frame, which enables rapid release of the module and rapid locking of the inserted module in the frame. The connector includes a lock which is slidable in the frame between locked and unlocked positions, in directions parallel to a first side of the cavity. The lock has a lock lug which lies at a first side of the cavity. The module, in its fully inward and installed position, has a barrier part which lies directly inward of the lock lug, when the lock is in its locked position, When the lock is slid to its unlocked position, the lock lug moves so a gap in the lock lies directly outward of the barrier part. This allows the barrier part and the rest of the module to be moved outwardly out of the cavity. When the module is fully installed, the barrier limits the depth of module insertion.

A lock spring urges the lock toward its locked position. A latch, which hold the lock in its unlocked position, is slidably mounted on the frame to slide in directions perpendicular to the direction of lock sliding. In the unlocked position, a shoulder on the lock presses against an abutment on the latch, which prevents the lock from moving under the spring force to its locked position, until the latch is moved to an unlatched position.

The novel features of the invention are set forth with particularity in the appended claims. The invention will be best understood from the following description when read in conjunction with the accompanying drawings.

BRIEF DESCRIPTION OF THE DRAWINGS

FIG. 3 is a sectional inward view of a portion of the electrical connector of FIG. 1, with the lock in its locked position.

FIG. 4 is a view similar to that of FIG. 3, but with the lock in its unlocked position.

FIG. 5 is a sectional view of the latch of the connector of FIG. 3.

FIG. 6 is a plan view of the latch of FIG. 5.

FIG. 7 is a left side view of a lock arm of the connector of FIG. 3.

FIG. 8 is an outer view of the lock arm of FIG. 7.

FIG. 9 is a sectional view taken on the line 9—9 of FIG. 3, and also showing the module fully installed in the connector.

DESCRIPTION OF THE PREFERRED EMBODIMENT

Figure 1:
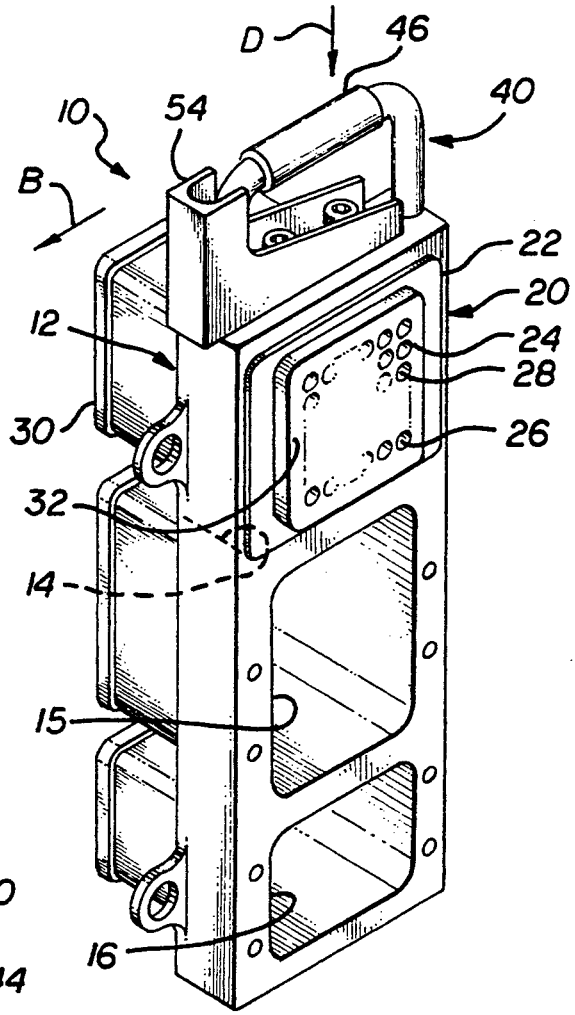
FIG. 1 is an isometric view of a multi-bay electrical connector constructed in accordance with the present invention, showing a first module in its fully installed position, and with two other cavities of the connector frame being empty, and with the lock in the locked position.

FIG. 1 illustrates an electrical connector 10 which includes a frame 12 having three cavities 14–16, and showing a first module 20 in a first of the cavities 14. The module includes a metal shell 22, a dielectric insert 24 lying in the shell and having multiple contact-receiving passages 26, and a plurality of contacts 28 lying in the passages. It may be noted that while a shell 22 is usually provided around the dielectric insert, it is possible for the module to not have a shell around the insert. The connector has an inward or mating end 30 which is designed to mate with a corresponding connector (not shown). The connector has a rear or outer end 32, and a group of wires may extend from the outer end of each module.

Figure 2:
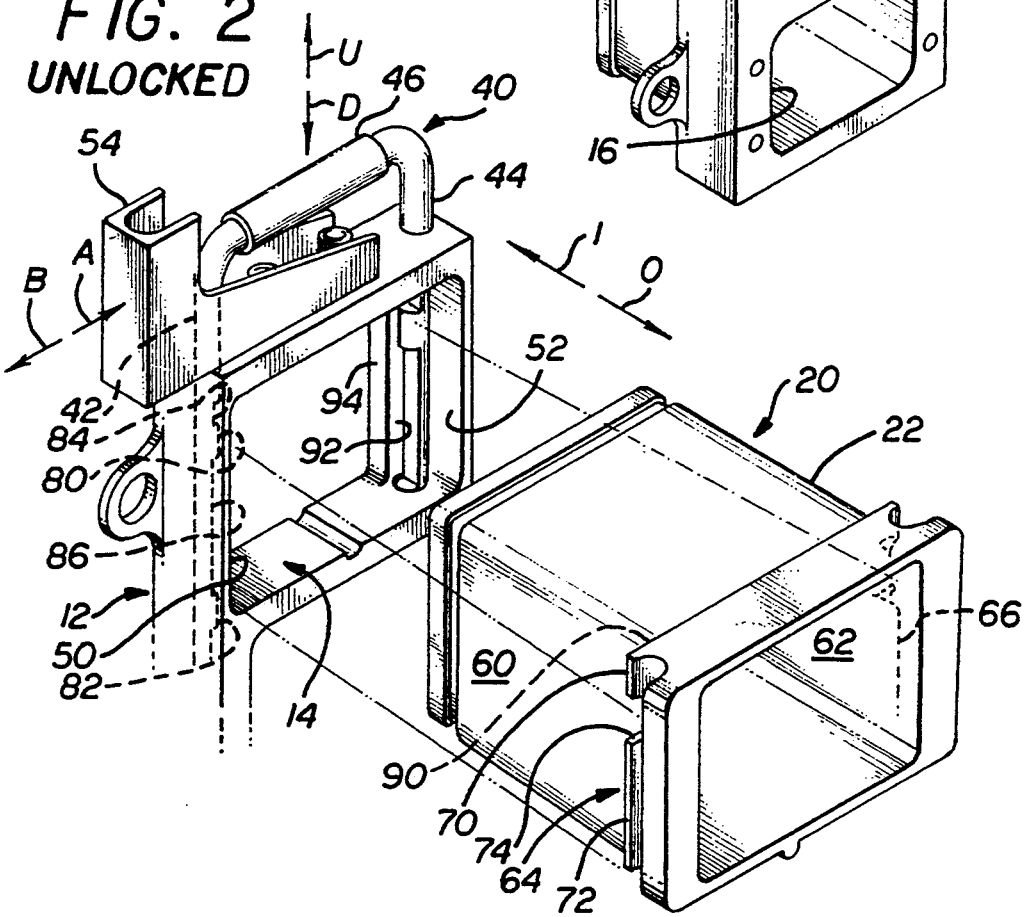
FIG. 2 is an exploded perspective view of part of the connector of FIG. 1, with the first module removed from the frame, and with lock in the unlocked position.

As shown in FIG. 2, the first module 20 is removable in an outward direction O from the frame cavity 14, and can be reinstalled by moving it in an inward direction I back into the cavity. When the first module has been installed in the frame, a lock 40 can be used to lock the module in place. The lock includes first and second arms 42, 44 that are elongated and extend in vertical or longitudinal directions U, D that are perpendicular to the inward and outward directions I, O. The upper ends of the arms are connected by a handle 46. The arms 42, 44 extend along first and second opposite sides 50, 52 of the first cavity 14, these opposite sides being spaced apart in lateral directions A, B, which are perpendicular to both the vertical directions and inward-outward directions.

The connector includes a latch 54 which is slidably mounted on the frame to slide in the lateral directions, and which holds the lock 40 in its unlocked position shown in FIG. 2.

FIG. 1 shows the connector in its locked position, with the lock 40 upward and the latch 54 in its unlatched position. With the connector in its locked position, the module 20 cannot be removed from the connector frame. In order to release the first module, a person depresses the lock handle 46 by pressing it down in the vertical direction D. As the lock approaches its down position the latch 54 moves in the lateral direction B under spring force to keep the lock down. FIG. 2 shows the lock 40 pressed down so the first module 20 can be removed and replaced, and shows the latch in the latched position. When the first module 20 has been moved fully in the inward direction I into its installed position, the person presses against the latch 54 in the direction A, until the lock 40 springs up to its locked position.

The module 20 has first and second opposite sides 60, 62 which lie near the first and second cavity sides 50, 52. The module shell has vertically-extending barriers 64, 66 at its opposite sides, which serve to retain the module in the frame. Each barrier has upper and lower barrier parts 70, 72 and each barrier forms a slot or opening 74 between the barrier parts. Each lock arm such as the first one 42 has upper and lower lugs 80, 82. Each arm forms upper and lower gaps 84, 86 in vertical alignment with the lugs. When the connector is in its unlocked position shown in FIG. 2, the module 20 can be inserted in the inward direction until an inwardly-facing shoulder 90 on the barrier abuts an outwardly-facing surface 92 on an inward portion 94 of the frame.

FIG. 9 shows the module 20 fully inserted into the frame 12, with the inwardly-facing shoulder 90 on the module abutting the outwardly-facing surface 92 on the frame. When the lock arm 42 is in its locked position, the upper lug 80 lies in the path of the upper barrier part 70, which prevents the module from moving in the outward direction O out of the frame cavity. If the lock arm 42 is moved vertically so that its upper gap 84 is aligned with the upper barrier 70, then the upper barrier can be moved outwardly and the module can be removed. Another way of looking at this is that when the lock arm 42 is moved to its unlocked position, the opening 74 in the barrier is aligned with the lock lug 80, which permits the module to be removed.

FIG. 3 shows the lock arm 42 in its upward or locked position, wherein the upper lock lug 80 lies directly outward of the upper barrier part 70, which prevents module removal. At the same time, the lower lug 82 lies in line with a portion of the lower barrier part 72, which prevents the lower part of the module from being pulled out. In a similar manner, the upper and lower lugs of the second arm 44 interfere with corresponding upper and lower barrier parts of the second barrier, so that the module is locked in place at both its first and second sides. FIG. 4 shows the lock 40 moved downwardly to its unlocked position, showing that the barrier parts 70, 72 lie within gaps 84, 86 of the lock arm, or in other words so the barrier opening 74 is aligned with the upper lock lug 80.

The lock 40 is biased in an upward direction towards the locked position of FIG. 3, by a pair of lock springs 100, 102. The lock springs are coil or helical springs which press upwardly against lower ends of the lock arms. It would be possible to merely require a technician to depress the lock 40 and keep it depressed while pulling out the module. However, this requires the technician to use one hand to keep the lock depressed, so only one hand is available to withdraw the module. Applicant prefers to provide a latch 54 which automatically keeps the lock in its downward or unlocked position. The latch 54 is slidably mounted on the frame to slide in the opposite lateral directions A, B. A latch spring 110 urges the latch in the direction B towards its latched position shown in FIG. 4, wherein it keeps the lock 40 downward in its unlocked position. The latch has an abutment 112, as shown in FIG. 5, which lies against an upwardly-facing locking shoulder 114 on the first lock arm 42. With the abutment 112 of the latch lying over the shoulder 114, the latch prevents the arm 42 from moving upwardly under the force of the lock springs. Thus, in the latched position, the latch prevents the arm 42, and therefore the rest of the lock, from moving upwardly, to thereby keep the lock in its open or unlocked position.

After a technician installs a module in the frame, he presses the latch in the direction A, against the force of the latch spring, until a bar-receiving slot part 120 in the latch has moved into alignment with the latch arm 42, so a latching lug device 122 on the lock arm can be received in the slot part 120. That is, the latch slot part 120 (FIG. 6) is wide enough so the locking shoulder 114 can move up into the latch slot. This allows the lock device to move up under the biasing force of the lock springs, to the locked position. When the lock arm moves up, the latch lug device 122, lies in the latch slot part 120, and prevents the latch from moving in the direction B, because the latch lug device 122 cannot move into a narrow slot part 124.

When the module is fully installed in the frame and the lock is moved upward to its locked position, the module is captured against outward movement at both its first and second opposite sides, and at both the upper and lower portions of each side. Such capturing prevents cocking of the module when outward forces are applied to it during mating of the module with another connector; that is, it prevents tilting of the module which could result in misalignment of the contacts of the module with those of a mating connector. It is noted that applicant prefers to let the lock 40 slide in a vertical direction, which is parallel to the spacing of the plurality of cavities from each other. This is desirable because it allows for long lock arms and does not affect the spacing between cavities, but only results in a slightly wider (in a lateral direction) of the frame.

Applicant constructs and assembles the connector by first forming the frame with vertical lock-arm receiving passages 130, 132 (FIG. 3) that extend downwardly from the top of the frame and which have blind lower ends. The helical springs 100, 102 are dropped into the passages. The lock arms are formed from steel rods with 90° bends at their upper ends as shown, and as shown in FIGS. 7 and 8, with the gaps 84, 86, groove 134, and recess 136. The two lock arms can be identical, but recesses 136 at their lower ends lie on different sides and only one requires the groove 134. The upper ends of the lock arms are joined by the handle 46, and the lock arms are slid down into the passages of the frame. Then, retaining pins 140, 142 are installed in laterally-extending holes in the frame, to pass across the recesses 136 of the arms and retain them in place. The latch 54 is constructed as shown, with the slot parts 120, 124 shown, and with additional slots 140, 142. Prior to installing the lock, the latch is installed by placing it as shown in FIG. 4, and installing screws 144, 146 through a holddown 150 that slidably guides the latch and prevents its loss from the frame. With the latch pressed in the direction A, the lock is installed and the retainer pins are installed as shown. Thereafter, the lock is pressed down to the position shown in FIG. 4, the module is installed, and the latch is pressed in the direction A so the arm moves up and locks the module in place.

The illustrated latch only serves to keep the lock in its unlocked position, until the latch is pushed in the direction A (FIG. 4). However, it is possible to modify the latch so that in the locked position (FIG. 3) it requires a slight latch movement in direction A before the lock 40 can be pressed down.

While terms such as "vertical" have been used herein to describe the connector as illustrated in the drawings, it should be understood that the connector can be used in any orientation with respect to gravity.

Thus, the invention provides an electrical connector with a removable module, wherein the module can be rapidly removed and installed from locations at the outside of the frame rather than from locations immediately inward or outward of the module and the frame cavity. The frame has a passage which slidably receives a lock that can move between locked and unlocked positions. The lock has at least one lock lug that slides along a first side of the frame cavity. The module has a barrier part which lies directly inward of the lock lug when the lock is in its locked position, but the barrier part lies in line with a gap in the lock when the lock is in the unlocked position to allow the module to be removed in the outward direction. A latch is slidably mounted on the frame to move in directions perpendicular to the direction of lock movement. While the lock is biased towards the locked position, the latch keeps the lock in its unlocked position, so a technician can use both hands to pull out and reinstall the module.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. An electrical connector which includes a frame having a plurality of vertically-spaced cavities that each has opposite first and second sides which are spaced in a lateral direction and a plurality of modules which lie in said cavities including a first module which lies in an inserted position within a first of said cavities, said first module including a dielectric insert having a plurality of passages and a plurality of contacts lying in said passages, wherein said first module can be removed in an outward direction from said first cavity and inserted in an inward direction into said first cavity to said inserted position, characterized by:

a lock which has a lock arm that is slidably mounted in said frame to slide in vertical directions between locked and unlocked positions, said lock arm having at least one lock lug which lies at said first side of said cavity and having a gap which is vertically spaced from said lock lug;

said first module including a barrier that has a barrier part that lies at said first side of said first cavity;

said lock arm and first module being constructed so when said first module is in said inserted position and said lock arm is in said locked position said barrier part lies directly inward of said lock lug, and when said first module is in said installed position and said lock arm is in said unlocked position said barrier part lies directly inward of said gap;

said vertical directions are perpendicular to said lateral direction and perpendicular to said outward and inward directions, so said lock lug and gap move parallel to said first side of said cavity.

2. The electrical connector described in claim 1 wherein:

said lock has connected first and second parallel arms lying respectively at said first and second sides of said first cavity with each arm being slidable in said longitudinal direction and with each arm having a lock lug, and said first module has a barrier part lying directly inward of the lock lug of each arm only when said lock is in said locked position.

3. The electrical connector described in claim 1 wherein:

said first cavity has an axis, said frame has inner and outer frame parts at said first side of said first cavity, with said outer frame part lying further from said axis than with said inner frame part forming a generally outwardly facing surface where said frame parts meet, and said lock comprises an elongated arm that lies in the space between said outer frame part and an imaginary outward extension of said inner frame part.

4. The electrical connector described in claim 3 wherein:

said barrier part of said first module lies against said outwardly-facing surface when said first module is in said inserted position, to limit inward movement of said first module.

5. An electrical connector which includes a frame having a cavity with opposite first and second sides which are spaced in a lateral direction and a module which lies in an inserted position within said cavity, said module including a dielectric insert having a plurality of passages and a plurality of contacts lying in said passages, wherein said module can be removed in an outward direction from said frame cavity and inserted in an inward direction into said frame cavity to said inserted position, characterized by:

a lock which is slidably mounted in said frame to slide in longitudinal directions between locked and unlocked positions, said lock having at least one lock lug which lies at said first side of said cavity and a gap which is longitudinally spaced from said lock lug;

said module including a barrier that has a barrier part that lies at said first side of said cavity;

said lock and module being constructed so when said module is in said inserted position and said lock is in said locked position said barrier part lies directly inward of said lock lug, and when said module is in said installed position and said lock is in said unlocked position said barrier part lies directly inward of said gap;

said longitudinal directions are perpendicular to said lateral direction and perpendicular to said outward and inward directions, so said lock lug and gap move parallel to said first side of said cavity;

a lock spring which urges said lock in a first of said longitudinal directions toward said locked position;

a latch which is slidably mounted on said frame to slide in said lateral direction between latched and unlatched positions wherein said latch respectively prevents and does not prevent said lock from moving from said unlocked position to said locked position;

said lock has a locking shoulder and said latch has an abutment which lies against locking shoulder when said latch is in said latched position, to keep said lock in said unlocked position, said abutment being positioned so it lies out of the path of said locking shoulder when said latch moves to said unlatched position.

6. The electrical connector described in claim 5 including a latch spring coupled to said frame and urging said latch toward said latched position, said frame having a stop which limits latch movement away from said unlatched position no further than said latched position.

7. An electrical connector which includes a frame having laterally spaced opposite sides and vertically spaced opposite ends, said frame having a plurality of vertically spaced cavities that each holds a module, including a first module that can be removed from a first cavity along a horizontal outward direction that is perpendicular to both said lateral and vertical directions and that can be inserted into the cavity in an opposite inward direction, characterized by:

said first cavity has laterally-spaced opposite sides, and said cavity has a narrow inner portion and has a wider outer portion with a greater width in said lateral direction than said inner portion, said cavity inner portion having walls at its outer end that form an outer surface;

said first module includes a shell with an inner part that is closely received in said cavity inner portion, and with an outer part having a shell side wall that forms a barrier which lies directly outward of said outer surface of said cavity walls, said barrier having an opening at a particular height;

a lock in the form of an elongated arm that can slide vertically in said frame between locked and unlocked positions, said lock having a lock portion which lies at said first side of said first cavity, at a location outward of said outer surface of said cavity walls, said lock portion having a lock lug which lies directly outward of said barrier in the locked position of the arm and which lies directly outward of said opening in said barrier in the unlocked position of the arm;

a latch which is slidably mounted on said frame to enable it to slide in a direction which is perpendicular to said vertical direction between latched and unlatched positions, said lock arm having a vertically facing shoulder positioned to abut said latch and said latch having an abutment which abuts said lock arm shoulder only when said latch is in said latched position.

8. A method for constructing and operating an electrical connector which includes a frame having laterally spaced opposite sides and vertically spaced opposite ends, wherein the frame has at least one cavity, and wherein the connector includes a module that can be inserted in an inward direction into said cavity to lie in an inserted position therein and that can be moved in an outward direction out of said cavity, characterized by:

forming a vertically extending passage in said frame, which extends downwardly from the top of said frame and which is aligned with a first side portion of said cavity;

forming a lock arm with an upper handle end and installing said arm in said passage so said arm can move vertically between locked and unlocked positions therein, including forming at least one gap in said arm that moves up and down with said arm;

forming said module with a barrier part which lies at a predetermined position directly inward of a portion of said lock arm when said module lies in said inserted position and said lock arm is in said locked position;

maintaining said lock arm in said unlocked position with said gap lying directly outward of said predetermined position of said barrier part and moving said module inwardly into said cavity until said barrier part lies inward of said lock arm, and then sliding said lock arm vertically to said locked position;

continually biasing said lock arm away from said unlocked position toward said locked position;

forming said lock arm with a vertically facing shoulder;

installing a latch on said frame so said latch can slide in said lateral direction between latched and unlatched positions, including forming said latch with an abutment that abuts said lock arm shoulder in one of said lock arm positions to prevent said lock arm from moving vertically until said latch is moved laterally.

* * * * *